US006189525B1

(12) United States Patent
Kutrubes

(10) Patent No.: US 6,189,525 B1
(45) Date of Patent: Feb. 20, 2001

(54) PAINTBALL GUN TRIGGER WITH UPPER AND LOWER FINGER GRIPPING PORTIONS

(75) Inventor: Thomas J. Kutrubes, Longmont, CO (US)

(73) Assignee: K&K Performance Paintball, Longmont, CO (US)

( * ) Notice: Under 35 U.S.C. 154(b), the term of this patent shall be extended for 0 days.

(21) Appl. No.: 09/432,825

(22) Filed: Nov. 2, 1999

(51) Int. Cl.[7] ..... F41A 19/10
(52) U.S. Cl. ..... 124/31; 42/69.01
(58) Field of Search ..... 42/69.01, 69.02, 42/69.03, 65, 90; 124/31, 37, 66, 67, 73, 74, 76

(56) References Cited

U.S. PATENT DOCUMENTS

| | | | | |
|---|---|---|---|---|
| 15,144 | * | 6/1856 | North | 42/69.01 |
| 32,333 | * | 5/1861 | Alsop | 42/65 |
| 337,201 | * | 3/1886 | Schlund | 42/65 |
| 361,100 | * | 4/1887 | Wesson | 42/65 |
| D. 399,914 | | 10/1998 | Walker | D22/108 |
| 3,269,045 | * | 8/1966 | McGaughey | 42/65 |
| 4,514,923 | * | 5/1985 | Teel | 42/69.01 |
| 4,685,379 | * | 8/1987 | Troncoso | 42/69.01 |
| 4,835,893 | * | 6/1989 | Kelso | 42/69.01 |
| 5,967,133 | * | 10/1999 | Gardner et al. | 124/77 |

FOREIGN PATENT DOCUMENTS

438214 * 12/1926 (DE) ..... 42/69.01

OTHER PUBLICATIONS

Photographs of gun trigger manufactured by WDP LTD, Birmingham, England (6 pages).*

* cited by examiner

*Primary Examiner*—Michael J. Carone
(74) *Attorney, Agent, or Firm*—David M. Sigmond

(57) ABSTRACT

A paintball gun trigger is disclosed. The trigger includes an upper finger gripping portion adapted to be gripped by an upper finger without surrounding the upper finger, and a lower finger gripping portion adapted to be gripped by a lower finger while surrounding the lower finger. Preferably, the upper finger gripping portion is an arcuate lever adapted to receive an index finger and the lower finger gripping portion is a ring adapted to receive a middle finger. In this manner, the index finger can actuate the trigger in a first horizontal direction to fire the gun and move in a second horizontal direction opposite to the first horizontal direction without engaging the trigger, and the middle finger can actuate the trigger in the first horizontal direction to fire the gun and engage the trigger when moved in the second horizontal direction. Advantageously, the index finger can be straightened or wiggled to reduce stiffness or fatigue and then rapidly and conveniently brought back into engagement with the upper finger gripping portion while the middle finger remains engaged with and locked in position by the lower finger gripping portion.

20 Claims, 4 Drawing Sheets

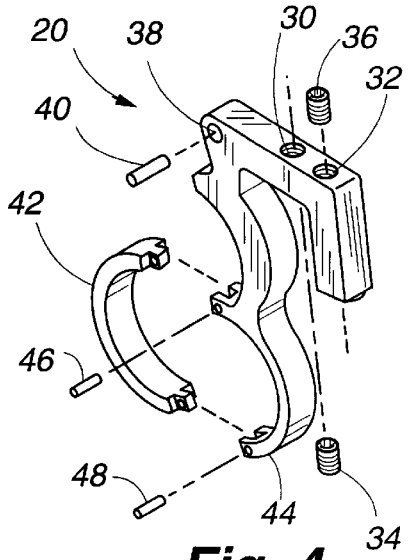
Fig. 4
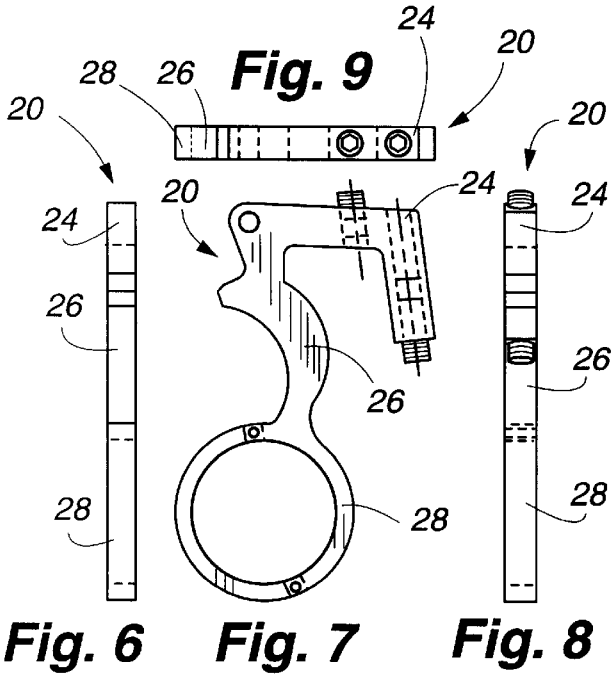
Fig. 9
Fig. 6 Fig. 7 Fig. 8
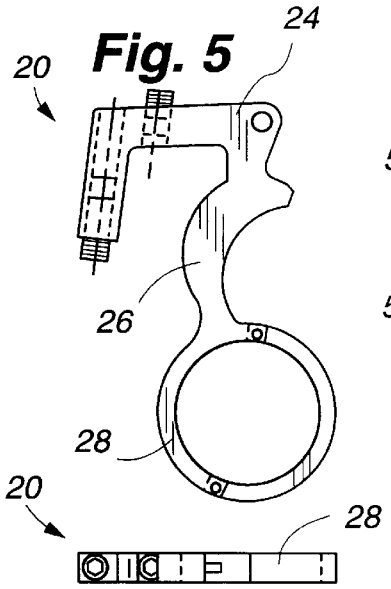
Fig. 5
Fig. 10
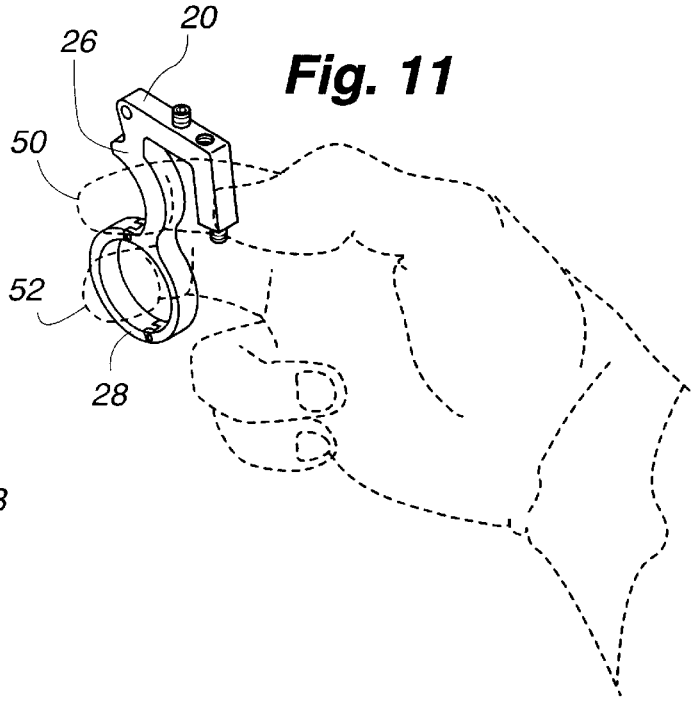
Fig. 11

PAINTBALL GUN TRIGGER WITH UPPER AND LOWER FINGER GRIPPING PORTIONS

BACKGROUND OF THE INVENTION

1. Field of the Invention

The present invention relates generally to triggers, and more particularly to triggers for use in paintball guns.

2. Description of Related Art

The sport of paintball has become increasingly popular in recent years. In the most common version of the game, two teams attempt to capture the opposing team's flag. Although no official clothing is mandated, surplus military gear has become a common uniform. The players each carry a gas-powered paintball gun that shoots paintballs at high velocity and a considerable distance. The paintballs are gelatin covered spherical capsules which contain a colored liquid that is non-toxic, water-soluble, hypo-allergenic and biodegradable. When a paintball hits a player, the paintball ruptures and leaves a colored splat, and the player leaves the game.

Paintball guns typically include a barrel from which paintballs are ejected, a chamber coupled to the barrel, an in-feed tube which provides access to the chamber, a hopper which is mounted to the in-feed tube and supplies paintballs to the chamber via the in-feed tube, a compressed gas tank, a conduit which couples an outlet valve of the compressed gas tank to the chamber, and a trigger. When the trigger is actuated, compressed gas is delivered to the chamber which forcibly ejects a paintball from the barrel.

Semi-automatic paintball guns are designed for very rapid firing, for instance 800 rounds during a 10–15 minute game. As a result, paintball gun triggers have been developed having an upper finger gripping portion with an arcuate lever shape for engaging the index finger and a lower finger gripping portion with an actuate lever shape for engaging the middle finger. Such dual finger triggers facilitate rapid firing by allowing the player to alternate the trigger-squeezing finger. This also reduces finger fatigue. A drawback to this approach, however, is that considerable finger slippage can occur. If the player decides to straighten or wiggle a finger in order to reduce stiffness or fatigue, then the other finger can easily slide out of position and cause the player to lose critical time before either finger is suitably positioned to fire the next shot. Furthermore, even if an immediate shot is not necessary, the process of repositioning the fingers on the trigger can be awkward and distracting.

Accordingly, a need exists for a paintball gun trigger which reduces finger slippage, fatigue and stiffness and improves finger control.

SUMMARY OF THE INVENTION

The present invention addresses these and other problems. Generally speaking, the present invention provides a trigger that includes an upper finger gripping portion adapted to be gripped by an upper finger without surrounding the upper finger, and a lower finger gripping portion adapted to be gripped by a lower finger while surrounding the lower finger.

Preferably, the upper finger gripping portion is an arcuate lever adapted to receive an index finger and the lower finger gripping portion is a ring adapted to receive a middle finger. In this manner, the index finger can actuate the trigger in a first horizontal direction to fire the gun and move in a second horizontal direction opposite to the first horizontal direction without engaging the trigger, and the middle finger can actuate the trigger in the first horizontal direction to fire the gun and engage the trigger when moved in the second horizontal direction.

Advantageously, the index finger can be straightened or wiggled to reduce stiffness or fatigue and then rapidly and conveniently brought back into engagement with the upper finger gripping portion while the middle finger remains engaged with and locked in position by the lower finger gripping portion.

These and other objects, features and advantages of the invention will be further described and more readily apparent from a review of the detailed description of the preferred embodiments which follows.

BRIEF DESCRIPTION OF THE DRAWINGS

The following detailed description of the preferred embodiments can best be understood when read in conjunction with the following drawings, in which:

FIG. 4 is an exploded perspective view of the trigger of the present invention showing pieces of the lower finger gripping portion;

FIG. 5 is a left-side view of the trigger of the present invention;

FIG. 6 is a front view of the trigger of the present invention;

FIG. 7 is a right-side view of the trigger of the present invention;

FIG. 8 is a rear view of the trigger of the present invention;

FIG. 9 is a top view of the trigger of the present invention;

FIG. 10 is a bottom view of the trigger of the present invention;

FIG. 11 is a perspective view of the trigger of the present invention showing a human hand in which the index and middle fingers engage the upper and lower finger gripping portions, respectively;

DETAILED DESCRIPTION OF THE PREFERRED EMBODIMENTS

Figure 1:
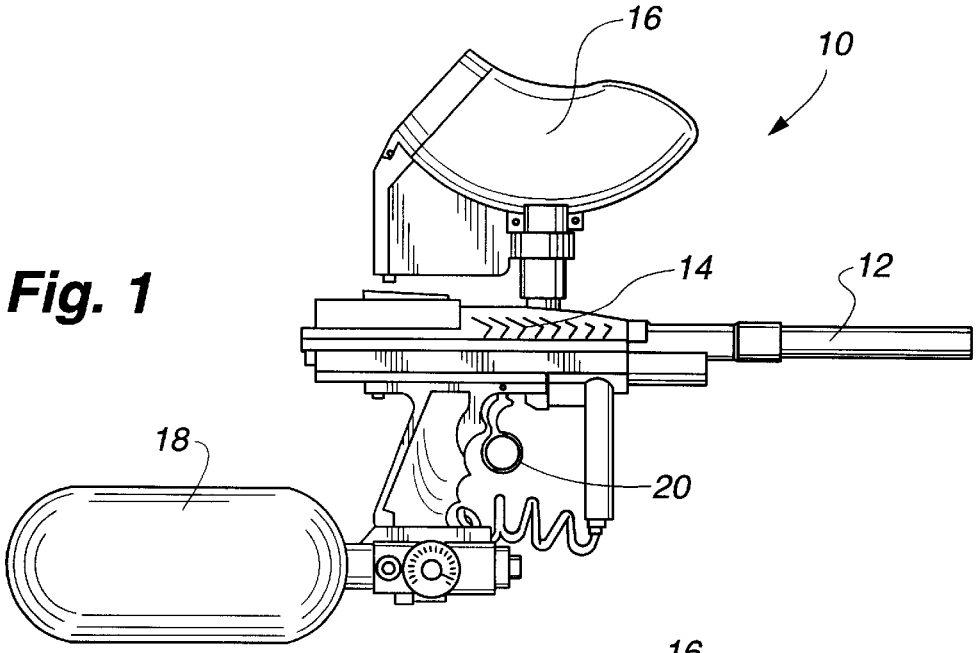
FIG. 1 is a side view of a paintball gun that includes a trigger in accordance with the present invention.
Figure 2:
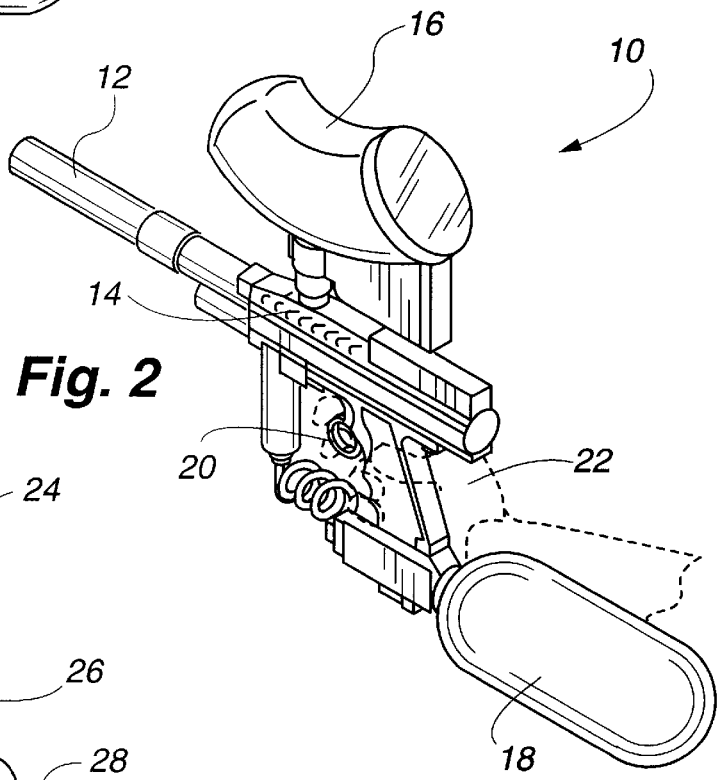
FIG. 2 is a perspective view of the paintball gun of FIG. 1.

FIGS. 1 and 2 show a paintball gun 10 which includes a barrel 12, a chamber 14, a hopper 16, a compressed gas tank 18, a trigger 20, and other conventional parts. Hopper 16 supplies paintballs (not shown) to chamber 14, and actuation of trigger 20 by human hand 22 (shown in phantom in FIG. 2) causes compressed gas in tank 18 to be delivered to chamber 14 so that a paintball is forcibly ejected from barrel 12. All aspects of paintball gun 10 except for trigger 20 are conventional. Therefore, for convenience of illustration, the other aspects of paintball gun 10 are not described.

Figure 3:
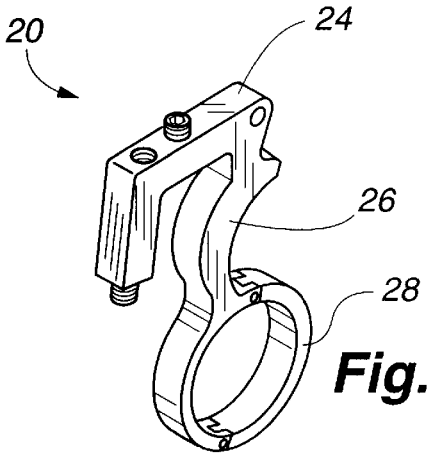
FIG. 3 is a perspective view of the trigger of the present invention.

FIGS. 3–10 show various views of trigger 20. FIG. 3 is a perspective view of trigger 20, FIG. 4 is an exploded perspective view of trigger 20 showing pieces of the lower finger gripping portion, FIG. 5 is a left-side view of trigger 20, FIG. 6 is a front view of trigger 20, FIG. 7 is a right-side view of trigger 20, FIG. 8 is a rear view of trigger 20, FIG. 9 is a top view of trigger 20, and FIG. 10 is a bottom view of trigger 20.

As is seen, trigger 20 includes upper body portion 24, upper finger gripping portion 26, and lower finger gripping portion 28. Upper body portion 24 is a comer-piece that includes threaded vertical through-holes 30 and 32 adapted to receive grub screws 34 and 36, respectively. Grub screw 34 extends into and above hole 30, and grub screw 36 extends into and below hole 32. Grub screws 34 and 36 are used to adjust trigger 20. Screwing grub screw 34 down lengthens the stroke and screwing grub screw 34 up shortens the stroke. Screwing grub screw 36 up moves trigger 20 forward and screwing grub screw 36 down moves trigger 20 backward. Thus, grub screw 36 adjusts the forward stroke of trigger 20. Preferably, grub screw 34 is screwed into hole 30 from the bottom of hole 30, and grub screw 36 is screwed into hole 32 from the top of hole 32. Grub screws 34 and 36 can be screwed into their respective holes and adjusted using a hex wrench. In addition, when trigger 20 is actuated, grub screw 36 contacts a micro-switch (not shown) that activates the firing mechanism in paintball gun 10. Upper body portion 24 also includes pivot hole 38 for receiving a pivot pin 40 about which trigger 20 can rotate. Pivot pin 40 also provides trigger 20 with an attachment point to paintball gun 10.

Upper finger gripping portion 26, which is attached to and disposed beneath upper body portion 24, is a downwardly extending arcuate lever adapted to receive an index finger. Lower finger gripping portion 28, which is attached to and disposed beneath upper finger gripping portion 26, is a ring adapted to receive a middle finger. Lower finger gripping portion 28 includes a front semicircular arc 42 and a rear semicircular arc 44. Arcs 42 and 44 are attached together by press-fitting upper and lower dowel pins 46 and 48, respectively, into the corresponding channels, for instance using a pliers. To facilitate assembly, front semicircular arc 42 can be attached to rear semicircular arc 44 by dowel pins 46 and 48 after the remainder of trigger 20 is mounted in paintball gun 10. Upper and lower finger gripping portions 26 and 28 have approximately the same height and radius. Upper body portion 24 and upper and lower finger gripping portions 26 and 28 are composed of anodized aluminum, and grub screws 34 and 36 and dowel pins 46 and 48 are composed of stainless steel. In addition, upper body portion 24, upper finger gripping portion 26 and rear semicircular arc 44 are composed of a single piece of anodized aluminum.

Figure 12:
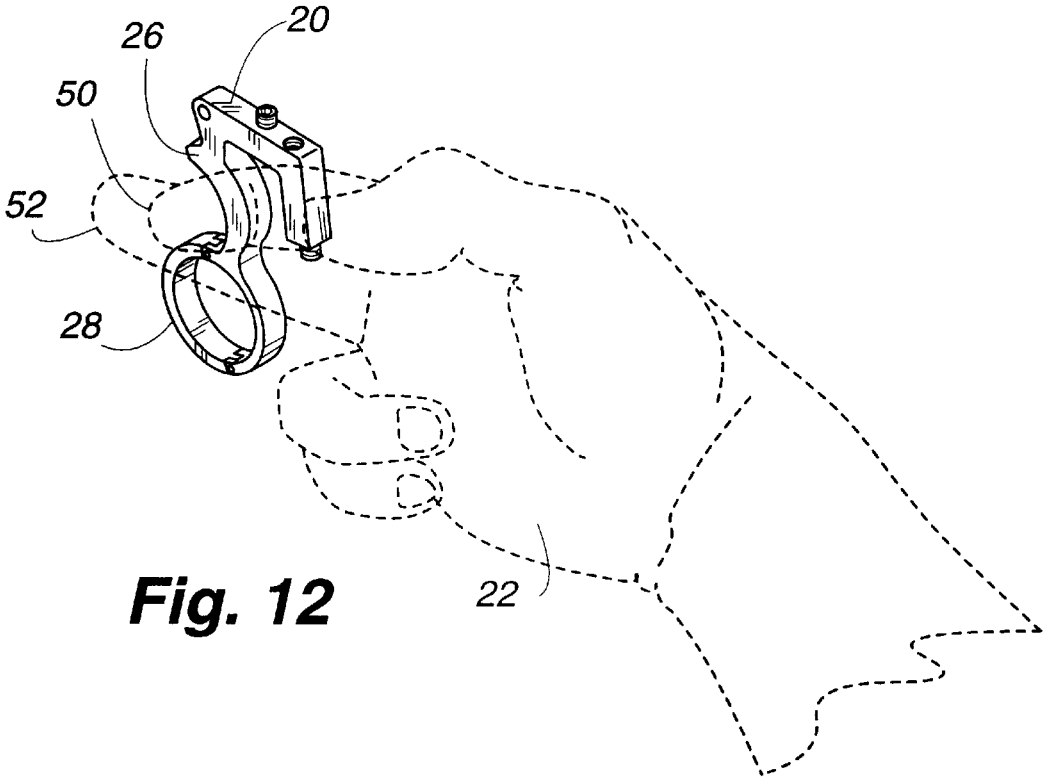
FIG. 12 is a perspective view of the trigger of the present invention showing a human hand in which the index finger engages the upper finger gripping portion without the middle finger engaging the lower finger gripping portion.
Figure 13:
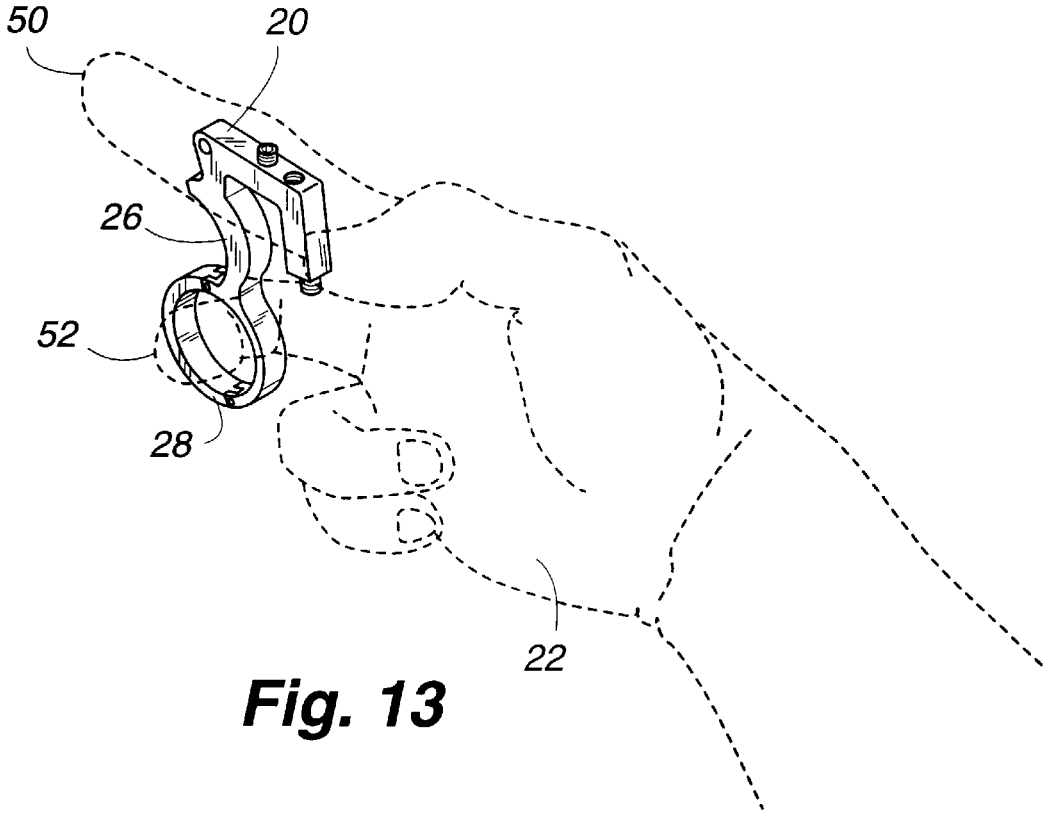
FIG. 13 is a perspective view of the trigger of the present invention showing a human hand in which the middle finger engages the lower finger gripping portion without the index finger engaging the upper finger gripping portion.

FIGS. 11–13 show perspective views of various ways in which a human hand can grip trigger 20. In FIG. 11, index finger 50 and middle finger 52 of human hand 22 engage upper and lower finger gripping portions 26 and 28, respectively. In FIG. 12, index finger 50 engages upper finger gripping portion 26 without middle finger 52 engaging lower finger gripping portion 28. In FIG. 13, middle finger 52 engages lower finger gripping portion 28 without index finger 50 engaging upper finger gripping portion 26. Thus, index finger 50 grips upper finger gripping portion 26 in FIGS. 11 and 12, and middle finger 52 is inserted into and is surrounded by and grips lower finger gripping portion 28 in FIGS. 11 and 13.

Advantageously, when middle finger 52 is inserted into and surrounded by lower finger gripping portion 28, middle finger 52 becomes anchored into position, thereby reducing finger slippage and improving finger control over trigger 20.

As can be appreciated, trigger 20 provides considerable flexibility in how it can be gripped and utilized by a player in order to optimize finger control, slippage, and fatigue. For instance, when middle finger 52 is inserted into lower finger gripping portion 28, index finger 50 can be withdrawn from upper finger gripping portion 26 and straightened or wiggled to reduce stiffness or fatigue while middle finger 52 remains engaged with and locked in position by lower finger gripping portion 28 to retain control over trigger 20 without finger slippage. Furthermore, index finger 50 and be easily and conveniently returned to engage upper finger gripping portion 26 as soon as index finger 50 is refreshed to reduce the demands on middle finger 52 during subsequent firing. Likewise, index finger 50 can engage upper finger gripping portion 26 as soon as middle finger 52 becomes fatigued. In either case, the freedom to straighten, wiggle or otherwise refresh index finger 50 while middle finger 52 is retained by lower finger gripping portion 28, and then quickly and easily return index finger 50 to upper finger gripping portion 26, is highly advantageous. Moreover, in the event middle finger 52 is withdrawn from lower finger gripping portion 28, for instance to temporarily move and refresh middle finger 52, index finger 50 can rapidly engage upper finger gripping portion 26 in order to fire paintball gun 10 without middle finger 52.

Figure 14:
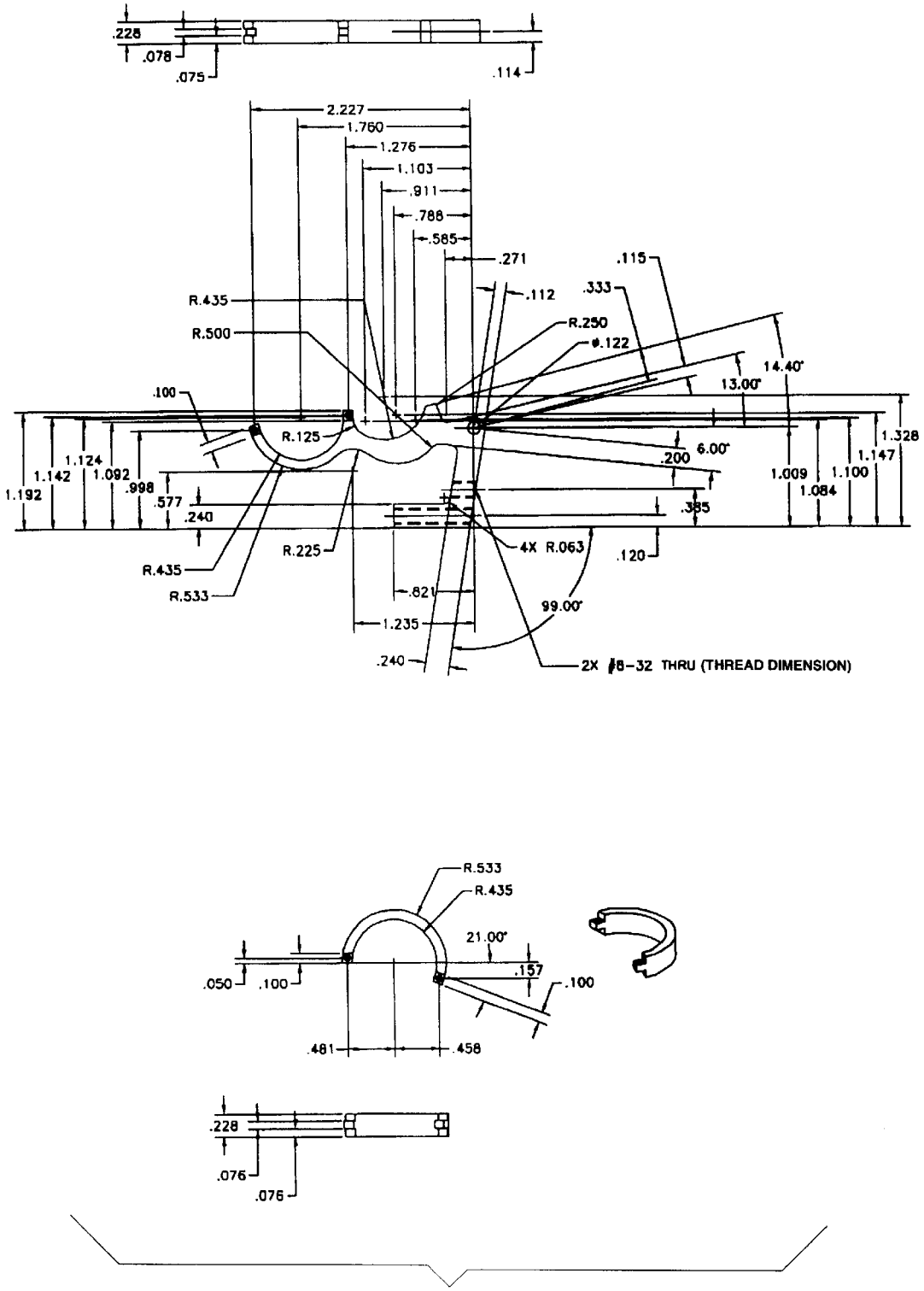
FIG. 14 is a diagram of the trigger of the present invention showing various dimensions and configuration details.

FIG. 14 shows various dimensions and configuration details for a presently preferred embodiment of trigger 20. The dimensions are in inches.

Although trigger 20 has been described in conjunction with paintball gun 10, it will be appreciated that the trigger of the present invention is well-suited for other types of firearms.

Variations and modifications of the embodiments disclosed herein may be made based on the description set forth herein without departing from the spirit and scope of the invention as set forth in the following claims.

What is claimed is:

1. A gun trigger, comprising:

a first finger gripping portion adapted to be gripped by a first finger without surrounding the first finger; and a second finger gripping portion adapted to be gripped by a second finger while surrounding the second finger, wherein the second finger gripping portion is attached to and disposed beneath the first finger gripping portion.

2. The gun trigger of claim 1, wherein the first finger gripping portion is an arcuate lever.

3. The gun trigger of claim 1, wherein the second finger gripping portion is a ring.

4. The gun trigger of claim 1, wherein the first finger gripping portion is an arcuate lever and the second finger gripping portion is a ring.

5. The gun trigger of claim 1, wherein the first finger gripping portion is adapted to engage the first finger when the first finger moves in a first horizontal direction and to release the first finger when the first finger moves in a second horizontal direction opposite to the first horizontal direction.

6. The gun trigger of claim 1, wherein the second finger gripping portion is adapted to engage the second finger when the second finger moves in a first horizontal direction and to engage the second finger when the second finger moves in a second horizontal direction opposite to the first horizontal direction.

7. The gun trigger of claim 1, wherein the first finger gripping portion is adapted to engage the first finger when the first finger moves in a first horizontal direction and to release the first finger when the first finger moves in a second horizontal direction opposite to the first horizontal direction, and the second finger gripping portion is adapted to engage the second finger when the second finger moves in the first horizontal direction and to engage the second finger when the second finger moves in the second horizontal direction.

8. The gun trigger of claim 1, wherein a top portion of the second finger gripping portion is adapted to support the first finger.

9. The gun trigger of claim 1, wherein the first finger is an index finger and the second finger is a middle finger.

10. The gun trigger of claim 1, wherein the gun trigger is adapted for use in a paintball gun.

11. A gun, comprising:

a trigger including:

an upper body portion for attachment to a pivot pin;

a first finger gripping portion adapted to be gripped by a first finger without surrounding the first finger, wherein the first finger gripping portion is attached to and disposed beneath the upper body portion; and a second finger gripping portion adapted to be gripped by a second finger while surrounding the second finger, wherein the second finger gripping portion is attached to and disposed beneath the first finger gripping portion.

12. The gun of claim 11, wherein the first finger gripping portion is an arcuate lever and the second finger gripping portion is a ring.

13. The gun of claim 12, wherein the first finger gripping portion is adapted to engage the first finger when the first finger moves the trigger in a first horizontal direction to fire the gun and to release the first finger when the first finger moves in a second horizontal direction opposite to the first horizontal direction, and the second finger gripping portion is adapted to engage the second finger when the second finger moves the trigger in the first horizontal direction to fire the gun and to engage the second finger when the second finger moves in the second horizontal direction.

14. The gun of claim 13, wherein the first finger is an index finger and the second finger is a middle finger.

15. The gun of claim 14, wherein the trigger consists of the upper body portion and the first and second finger gripping portions.

16. A paintball gun, comprising:

a barrel for ejecting paintballs;

a chamber coupled to the barrel;

a hopper for supplying the paintballs to the chamber;

a compressed gas tank; and a trigger, the actuation of which causes compressed gas to be delivered from the compressed gas tank to the chamber to forcibly eject one of the paintballs from the barrel, wherein the trigger includes (i) an upper finger gripping portion shaped as a downwardly extending arcuate lever and adapted to be gripped by an index finger without surrounding the index finger so that the index finger can actuate the trigger in a first horizontal direction to fire the gun and move in a second horizontal direction opposite to the first horizontal direction without engaging the trigger, and (ii) a lower finger gripping portion shaped as a ring and adapted to be gripped by a middle finger while surrounding the middle finger so that the middle finger can actuate the trigger in the first horizontal direction to fire the gun and the middle finger engages the trigger when the middle finger moves in the second horizontal direction, wherein the lower finger gripping portion is attached to and disposed beneath the upper finger gripping portion.

17. The paintball gun of claim 16, wherein the upper and lower finger gripping portions are the only finger gripping portions of the trigger.

18. The paintball gun of claim 16, wherein the upper and lower finger gripping portions have approximately the same radius.

19. The paintball gun of claim 16, wherein the upper and lower finger gripping portions have approximately the same height.

20. The paintball gun of claim 16, wherein the upper and lower finger gripping portions have approximately the same radius and height.

* * * * *